US010507646B2

(12) United States Patent
Kitai et al.

(10) Patent No.: US 10,507,646 B2
(45) Date of Patent: Dec. 17, 2019

(54) RECORDING APPARATUS AND RECORDING METHOD

(71) Applicant: CANON KABUSHIKI KAISHA, Tokyo (JP)

(72) Inventors: Satoshi Kitai, Kawasaki (JP); Kouichi Serizawa, Yokohama (JP); Masahiko Umezawa, Kawasaki (JP); Atsushi Takahashi, Kawasaki (JP); Shinsuke Ikegami, Tokyo (JP); Takeshi Murase, Yokohama (JP); Masashi Hayashi, Yokohama (JP); Yuki Sawai, Yokohama (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 15/709,278

(22) Filed: Sep. 19, 2017

(65) Prior Publication Data

US 2018/0086048 A1 Mar. 29, 2018

(30) Foreign Application Priority Data

Sep. 23, 2016 (JP) ..... 2016-186131

(51) Int. Cl.
*B41J 2/045* (2006.01)
*B41J 2/21* (2006.01)

(52) U.S. Cl.
CPC ..... *B41J 2/0451* (2013.01); *B41J 2/04543* (2013.01); *B41J 2/04546* (2013.01); *B41J 2/04586* (2013.01); *B41J 2/2132* (2013.01); *B41J 2/2139* (2013.01)

(58) Field of Classification Search
CPC .. B41J 2/0451; B41J 2/04546; B41J 2/04543; B41J 2/04586; B41J 2/2139; B41J 29/393
See application file for complete search history.

(56) References Cited

U.S. PATENT DOCUMENTS

2007/0211101 A1* 9/2007 Yamanobe ..... B41J 2/04508 347/19
2011/0285771 A1* 11/2011 Shinkawa ..... B41J 2/16579 347/9

FOREIGN PATENT DOCUMENTS

JP 2007-331193 A 12/2007

* cited by examiner

*Primary Examiner* — Kristal Feggins
*Assistant Examiner* — Kendrick X Liu
(74) *Attorney, Agent, or Firm* — Canon USA, Inc., IP Division

(57) ABSTRACT

Priority order is updated so that an ejection port that is selected as an ejection port subjected to ejection failure determination in a pixel row in which a previous ejection operation is to be performed has the lowest priority order, which is used for selecting an ejection port subjected to ejection failure determination, in a pixel row in which a subsequent ejection operation is to be performed.

13 Claims, 9 Drawing Sheets

| EJECTION PORT | 0 | 1 | 2 | 3 | 4 | 5 | 6 | 7 | 8 | 9 | 10 | 11 |
|---|---|---|---|---|---|---|---|---|---|---|---|---|
| 0 | 0 | 7 | 6 | 5 | 4 | 3 | 2 | 1 | 0 | 7 | 6 | 5 |
| 1 | 1 | 0 | 7 | 6 | 5 | 4 | 3 | 2 | 1 | 0 | 7 | 6 |
| 2 | 2 | 1 | 0 | 7 | 6 | 5 | 4 | 3 | 2 | 1 | 0 | 7 |
| 3 | 3 | 2 | 1 | 0 | 7 | 6 | 5 | 4 | 3 | 2 | 1 | 0 |
| 4 | 4 | 3 | 2 | 1 | 0 | 7 | 6 | 5 | 4 | 3 | 2 | 1 |
| 5 | 5 | 4 | 3 | 2 | 1 | 0 | 7 | 6 | 5 | 4 | 3 | 2 |
| 6 | 6 | 5 | 4 | 3 | 2 | 1 | 0 | 7 | 6 | 5 | 4 | 3 |
| 7 | 7 | 6 | 5 | 4 | 3 | 2 | 1 | 0 | 7 | 6 | 5 | 4 |

PIXEL ROW

| DRIVING ORDER | DRIVING BLOCK |
|---|---|
| 1 | 1 |
| 2 | 5 |
| 3 | 3 |
| 4 | 8 |
| 5 | 6 |
| 6 | 4 |
| 7 | 2 |
| 8 | 7 |

| EJECTION PORT | INITIAL PRIORITY ORDER | 0 | 1 | 2 | 3 | 4 | 5 | 6 | 7 | 8 | 9 | 10 | 11 |
|---|---|---|---|---|---|---|---|---|---|---|---|---|---|
| 0 | 7 | 7 | 6 | 5 | 4 | 7 | 6 | 5 | 4 | 3 | 2 | 1 | 0 |
| 8 | 7 | 7 | 6 | 7 | 6 | 5 | 4 | 3 | 2 | 1 | 0 | 0 | 0 |
| 16 | 7 | 7 | 7 | 6 | 5 | 4 | 3 | 2 | 1 | 0 | 0 | 0 | 0 |
| 24 | 7 | 7 | 6 | 5 | 7 | 6 | 5 | 4 | 3 | 2 | 1 | 0 | 0 |
| 32 | 7 | 7 | 6 | 5 | 4 | 3 | 7 | 6 | 5 | 4 | 3 | 2 | 1 |
| 40 | 7 | 7 | 6 | 5 | 4 | 3 | 2 | 1 | 7 | 6 | 5 | 7 | 6 |
| 48 | 7 | 7 | 6 | 5 | 4 | 3 | 2 | 7 | 6 | 7 | 6 | 5 | 7 |
| 56 | 7 | 7 | 6 | 5 | 4 | 3 | 2 | 1 | 0 | 0 | 0 | 0 | 0 |

PIXEL ROW

COUNTER RESET

| EJECTION PORT | INITIAL PRIORITY ORDER | 0 | 1 | 2 | 3 | 4 | 5 | 6 | 7 | 8 | 9 | 10 | 11 |
|---|---|---|---|---|---|---|---|---|---|---|---|---|---|
| 0 | 0 | 0 | 0 | 0 | 0 | 7 | 6 | 5 | 4 | 4 | 4 | 4 | 4 |
| 8 | 1 | 1 | 1 | 7 | 6 | 5 | 4 | 3 | 2 | 2 | 2 | 2 | 2 |
| 16 | 2 | 2 | 7 | 6 | 5 | 4 | 3 | 2 | 1 | 1 | 1 | 1 | 1 |
| 24 | 3 | 3 | 2 | 1 | 7 | 6 | 5 | 4 | 3 | 3 | 3 | 3 | 3 |
| 32 | 4 | 4 | 3 | 2 | 1 | 0 | 7 | 6 | 5 | 5 | 5 | 5 | 5 |
| 40 | 5 | 5 | 4 | 3 | 2 | 1 | 0 | 0 | 7 | 6 | 6 | 7 | 6 |
| 48 | 6 | 6 | 5 | 4 | 3 | 2 | 1 | 7 | 6 | 7 | 7 | 6 | 7 |
| 56 | 7 | 7 | 6 | 5 | 4 | 3 | 2 | 1 | 0 | 0 | 0 | 0 | 0 |

PIXEL ROW

COUNTER RESET

RECORDING APPARATUS AND RECORDING METHOD

BACKGROUND OF THE INVENTION

Field of the Invention

One disclosed aspect of the embodiments relates to a recording apparatus and a recording method.

Description of the Related Art

A recording apparatus in which, by using a recording head having an ejection port array in which a plurality of ejection ports that eject ink are arranged and ejecting ink while relatively moving the recording head and a recording medium, an image is recorded has been known.

In a case where such a recording apparatus has ejection failure of ink generated at an ejection port of the plurality of ejection ports, a blank area is generated on an image, so that image quality of the obtained image is deteriorated. In order to avoid this, it is required to accurately detect the ejection port in which ejection failure is generated.

Japanese Patent Laid-Open No. 2007-331193 describes that while performing a recording operation, residual vibration in a pressure chamber when a piezoelectric element is driven is detected by using a detection circuit shared by a plurality of ejection ports to thereby determine presence/absence of ejection failure of ink. This makes it possible to detect an ejection port in which ejection failure is generated even during the recording operation. Japanese Patent Laid-Open No. 2007-331193 also describes that when ink is ejected from the plurality of ejection ports, an ejection port that has the small number of times of ejection is selected as an ejection port for which presence/absence of ejection failure is determined preferentially.

Here, when one detection circuit is shared by the plurality of ejection ports, one pixel row allows determination of presence/absence of ejection failure only for one ejection port of the plurality of ejection ports. Thus, in order to evenly detect ejection failure in the plurality of ejection ports by using a plurality of pixel rows, it is necessary to select a different ejection port for each of the pixel rows as an ejection port for which presence/absence of ejection failure is determined.

Thus, priority order for selecting, for each of the pixel rows, an ejection port subjected to ejection failure determination is decided with respect to the plurality of ejection ports so that the priority order is differentiated between the pixel rows. As a result, ejection ports different between the pixel rows are selected as ejection ports preferentially subjected to the ejection failure determination.

FIGS. 1A and 1B are views for explaining an ejection port, subjected to ejection failure determination, that is selected in each of pixel rows when priority order for selecting an ejection port for the ejection failure determination is offset by one for each of the pixel rows. FIG. 1A illustrates the priority order in each of the pixel rows. FIG. 1B illustrates an example of recording data and indicates, when the recording data is acquired, which ejection port is actually selected as the ejection port subjected to the ejection failure determination in each of the pixel rows. Note that, for simplification, an aspect in which one ejection port is selected from eight ejection ports in total, i.e., ejection ports "0 to "7", in each of the pixel rows as illustrated in FIGS. 1A and 1B is described here.

In the priority order illustrated in FIG. 1A, a smaller number corresponds to higher priority order. That is, when priority order of "0" is described in a pixel row, it is indicated that a corresponding ejection port in the pixel row has the highest order. Each gray portion illustrated in FIG. 1B indicates a pixel in which ejection of ink is decided by the recording data and a portion marked with a circle indicates a position of an ejection port that is actually selected for the ejection failure determination.

In order to perform the ejection failure determination, ejection of ink needs to be decided by the recording data for a target ejection port. In the case of the pixel row "0", ejection of ink is decided for four ejection ports in total, i.e., ejection ports "2", "3", "6", and "7", as illustrated in FIG. 1B. Thus, in the pixel row "0", the ejection ports "2", "3", "6", and "7" are ejection ports for which the ejection failure determination is able to be performed. In accordance with the priority order in the pixel row "0" illustrated in FIG. 1A, the ejection port having the highest priority order in the ejection ports "2", "3", "6", and "7" is the ejection port "2" having the priority order of "2". Thus, the ejection port "2" is selected in the pixel row "0" as the ejection port subjected to the ejection failure determination.

In the pixel row "1", ejection of ink is decided for four ejection ports in total, i.e., ejection ports "1", "2", "5", and "6", as illustrated in FIG. 1B. In accordance with the priority order in the pixel row "1" illustrated in FIG. 1A, the ejection port having the highest priority order in the ejection ports "1", "2", "5", and "6" is the ejection port "1" having the priority order of "0". Thus, the ejection port "1" is selected in the pixel row "1" as the ejection port subjected to the ejection failure determination.

In the same manner, ejection ports are selected for the ejection failure determination also in the other pixel rows "2" to "11" as illustrated in FIG. 1B. As found from FIG. 1B, when the priority order as illustrated in FIG. 1A is followed, ejection ports are selected unevenly as ejection ports subjected to the ejection failure determination depending on the recording data.

SUMMARY OF THE INVENTION

In one embodiment, in a case where ejection failure determination is able to be performed only for one ejection port of a plurality of ejection ports in a pixel row, presence/absence of ejection failure is evenly determined for the ejection ports regardless of recoding data.

An aspect of the embodiments is a recording apparatus, including a recording head, an acquisition unit, a control unit, a selection unit, and a determination unit. In the recording head, a plurality of ejection ports for ejecting ink are arranged in a predetermined direction. The acquisition unit is configured to acquire recording data for deciding ejection or non-ejection of ink to each pixel. The control unit is configured to cause the recording head to perform an ejection operation from the plurality of ejection ports on a basis of the recording data while relatively moving the recording head and a recording medium in a cross direction crossing the predetermined direction. The selection unit is configured to select, from among the plurality of ejection ports in accordance with priority order of the plurality of ejection ports that is determined in advance, a target ejection port for ejection failure in each of a plurality of pixel rows arranged in the cross direction. In each of the plurality of pixel rows, a plurality of pixels are arranged in a predetermined direction. The determination unit is configured to determine, on a basis of the ejection operation, whether or not the target ejection port selected by the selection unit in each of the pixel rows in the cross direction has ejection failure are included. The selection unit updates priority order so that an ejection port selected by the selection unit in a pixel row corresponding to a previous ejection operation of two pixel rows adjacent to each other in the cross direction has lowest priority order in a pixel row corresponding to a subsequent ejection operation. The selection unit also selects, on a basis of the updated priority order, the target ejection port in the pixel row in which the subsequent ejection operation is to be performed.

Further features of the disclosure will become apparent from the following description of exemplary embodiments with reference to the attached drawings.

DESCRIPTION OF THE EMBODIMENTS

A first embodiment will be specifically described below with reference to drawings.

First Embodiment

Figures 1A, 1B:
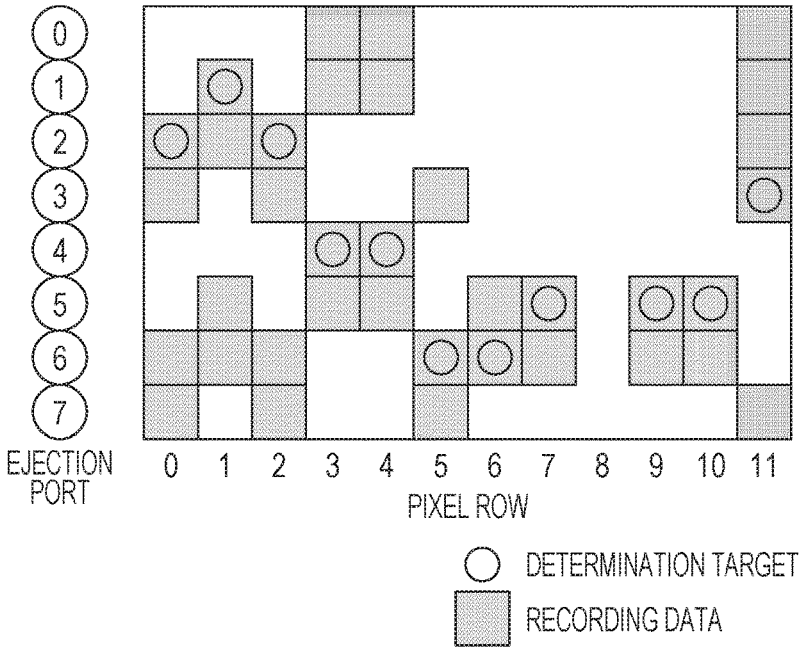
FIG. 1A (PRIOR ART)
FIG. 1B (PRIOR ART)
FIGS. 1A and 1B are views for explaining an example of ejection failure determination processing.
Figure 2:
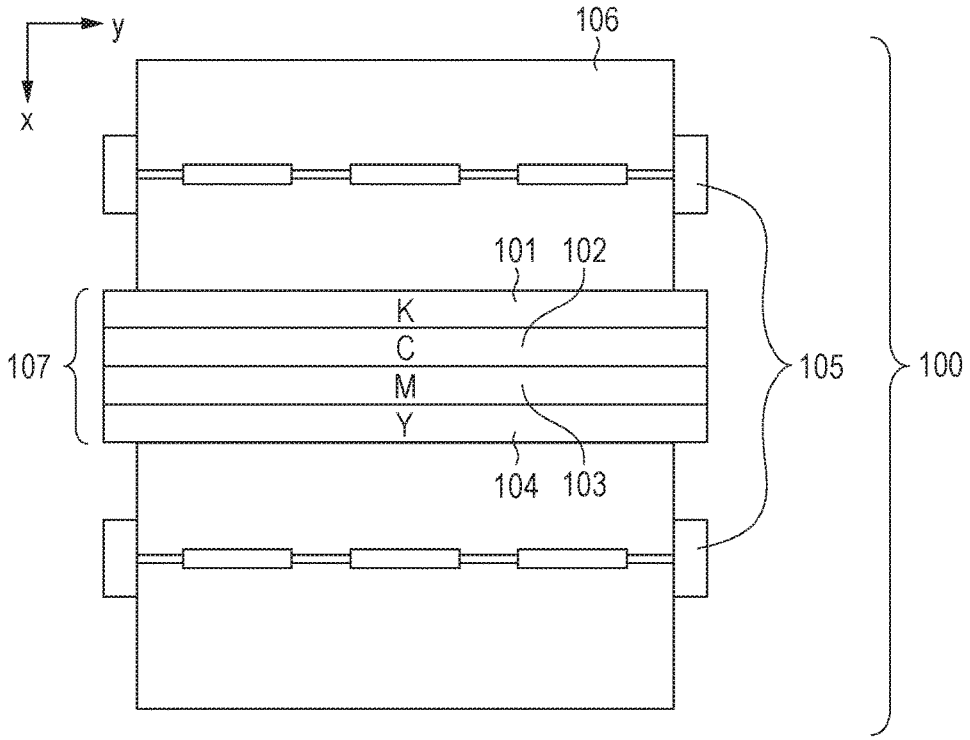
FIG. 2 is a schematic view illustrating an internal configuration of an image recording apparatus according to an embodiment.

FIG. 2 is a schematic view partially illustrating an internal configuration of an ink-jet recording apparatus according to the present embodiment.

An ink-jet recording apparatus (hereinafter, also referred to as a printer or a recording apparatus) 100 of the present embodiment includes a recording head group 107 having recording heads 101 to 104. The recording heads 101 to 104 are used to eject black ink (K ink), cyan ink (C ink), magenta ink (M ink), and yellow ink (Y ink), respectively. The recording heads 101 to 104 are formed so that a length of each of the recording heads 101 to 104 in a y direction (predetermined direction) is longer than a width of a recording medium 106 in the y direction. The recording head group 107 in the present embodiment is configured such that the recording heads 101 to 104 are arranged in an x direction (cross direction).

The recording medium 106 is conveyed (moved) in the x direction when conveyance rollers 105 (and other rollers (not illustrated)) are rotated by driving force of a conveyance motor (not illustrated). The conveyance (movement) of the recording medium 106 in the x direction may provide an effect substantially similar to those achievable by scanning with the recording head group 107 in the x direction. While the recording medium 106 is conveyed, an ejection operation of ink is performed in accordance with recording data described below from a plurality of ejection ports arranged in each of the recording heads 101 to 104. Thereby, an image is formed on the recording medium 106 by a single relative scan of the recording medium 106 in the x direction with the recording heads 101 to 104.

Figure 3A:
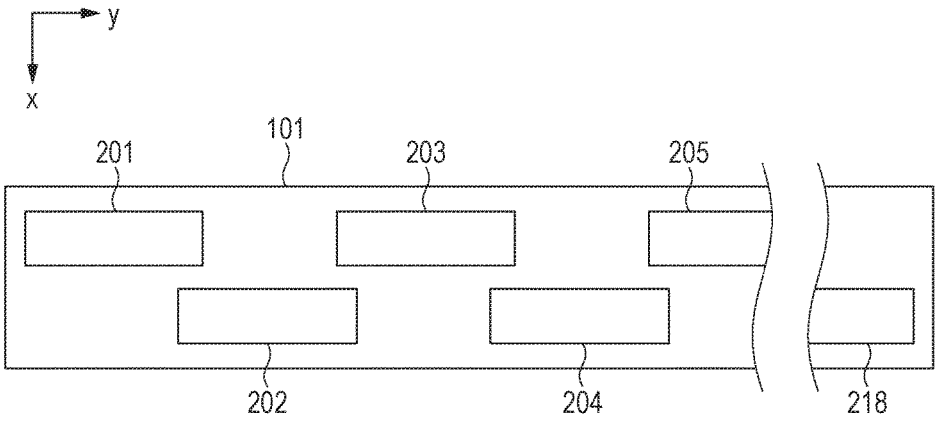
FIGS. 3A and 3B are schematic views illustrating a recording head according to the embodiment.

FIG. 3A is a schematic view illustrating a detailed configuration of the recording head 101 according to the present embodiment for ejecting black ink. The recording head 101 is configured such that 18 recording element substrates 201 to 218, each having a plurality of ejection port arrays described below, are arranged along the y direction so as to form a staggered pattern in which one end of one of the recording element substrates 201 to 218 in the y direction and the other end of another one of the recording element substrates 201 to 218 in the y direction are located at the same positions in the y direction. Thereby, the length of the recording head 101 in the y direction is longer than the width of the recording medium 106 in the y direction. Note that, a recording head applicable to the present embodiment is not limited to the recording head configured such that a plurality of recording element substrates are arranged in the y direction, as illustrated in FIG. 3A. For example, the recording head may be configured by only a single recording element substrate having an ejection port array with a length equal to or larger than the width of the recording medium 106.

Figure 3B:
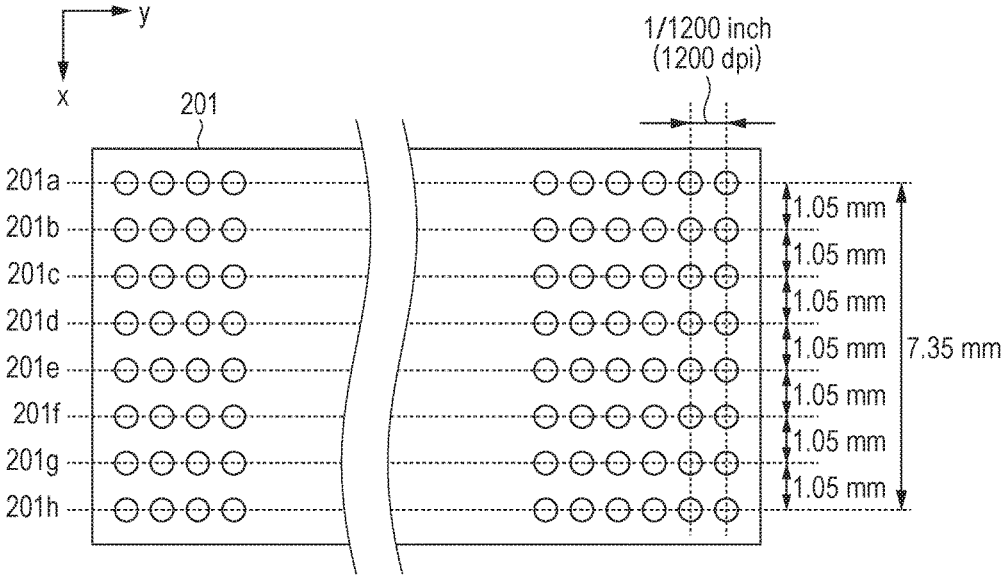

FIG. 3B is a schematic view illustrating a detailed configuration of the recording element substrate 201 illustrated in FIG. 3A according to the present embodiment. In the recording element substrate 201, 8 ejection port arrays 201*a* to 201*h* each of which has 1280 ejection ports, each ejecting black ink, arranged in the y direction with a resolution of about 1200 dpi (at intervals of 1/1200 inches) are arranged side by side in the x direction. Recording elements (not illustrated) are disposed directly below the ejection ports and thermal energy generated by the recording elements being driven causes ink immediately above to bubble so that ink is ejected from the ejection ports. The intervals between the ejection port arrays 201*a* to 201*h* may be different to some extent as long as the ejection ports are arranged substantially at the same intervals even if there is a slight manufacturing error. Though the recording element substrate 201 is described here, the recording element substrates 202 to 218 also have similar configurations.

Figure 4:
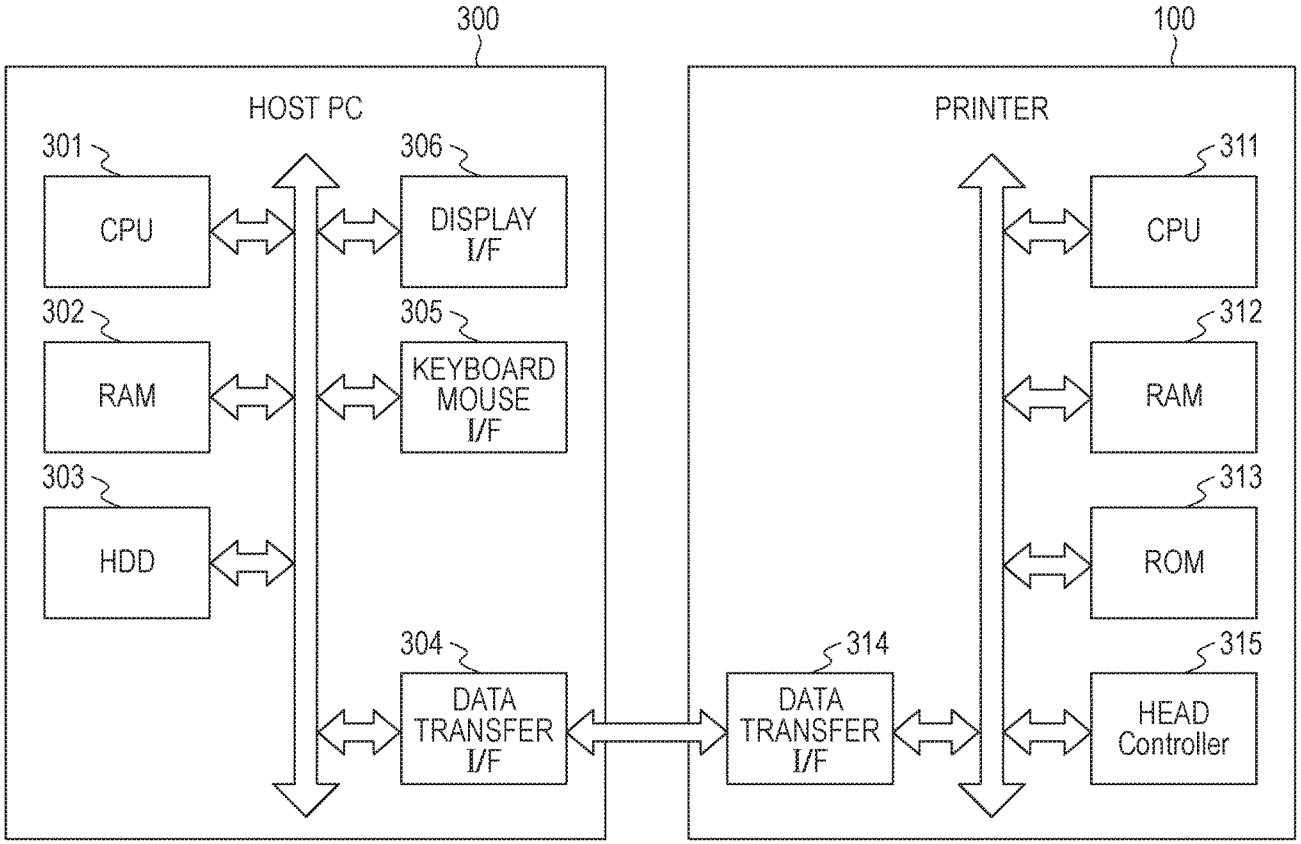
FIG. 4 is a view for explaining a recording control system according to the embodiment.

FIG. 4 is a block diagram illustrating a recording control system according to the present embodiment. As illustrated in FIG. 4, the recording system includes the printer 100 illustrated in FIG. 2 and a personal computer (hereinafter, referred to as a host PC) 300 as a host device of the printer 100.

The host PC 300 includes the following elements. A CPU 301 executes processing according to a program held in a RAM 302 or an HDD 303 each of which serves as a storage unit. The RAM 302 is a volatile memory and temporarily holds a program and data. The RAM 302 and/or the HDD 303 contain(s) instructions that, when executed by the CPU 301, cause the CPU 301 to perform operations described in the following. The HDD 303 is a non-volatile memory and also holds a program and data. In the present embodiment, a data transfer I/F (interface) 304 controls transmission and reception of data to and from the printer 100. As a connection scheme for the transmission and reception of data, a USB, an IEEE 1394, a LAN, or the like is able to be used. A keyboard mouse I/F 305 is an I/F for controlling an HID (Human Interface Device) such as a keyboard or a mouse, and a user is able to perform input through the keyboard mouse I/F 305. A display I/F 306 controls display on a display (not illustrated).

Meanwhile, the printer 100 includes the following elements. A CPU 311 executes each processing described below in accordance with a program held in a RAM 312 or a ROM 313. The RAM 312 is a volatile memory and temporarily holds a program and data. The ROM 313 is a non-volatile memory and is able to hold a priority order table and a program which are used for the processing described below. The RAM 312 and/or the ROM 313 contain(s) instructions that, when executed by the CPU 311, cause the CPU 311 to perform operations described in the following.

A data transfer I/F 314 controls transmission and reception of data to and from the host PC 300. A head controller 315 supplies recording data described below to the recording heads 101 to 104 illustrated in FIG. 2, and controls ejection operations of the recording heads 101 to 104. Specifically, the head controller 315 may be configured to read a control parameter and recording data from a predetermined address on the RAM 312. When the CPU 311 writes a control parameter and recording data to the predetermined address on the RAM 312, processing is started by the head controller 315 and ink is ejected from the recording heads 101 to 104.

(Process of Data Processing)

Figure 5:
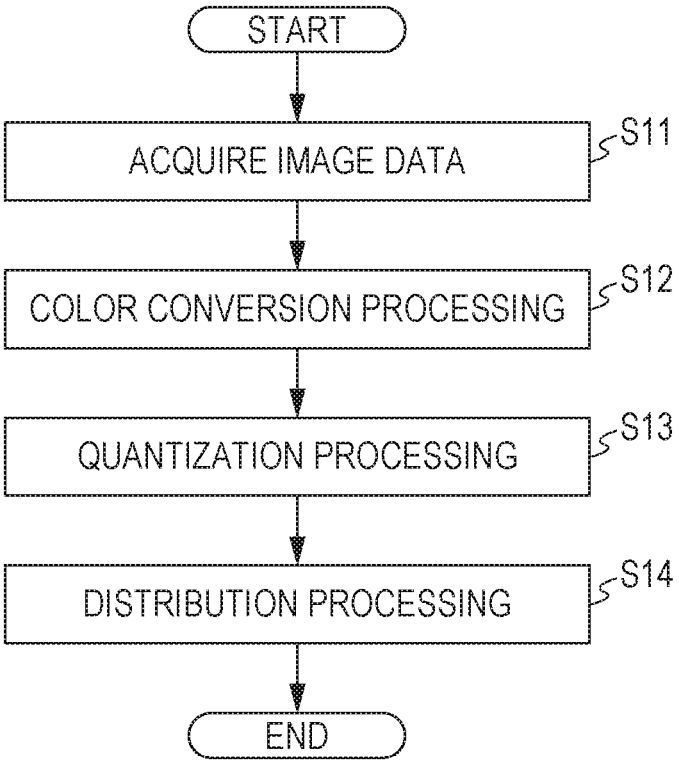
FIG. 5 is a flowchart indicating a process of image processing according to the embodiment.

FIG. 5 is a flowchart indicating a process of image processing executed by the CPU 301 in accordance with a control program in the present embodiment. Note that, the control program is stored in the ROM 302 in advance.

When recording processing starts, first, the recording apparatus 100 acquires image data indicated by an R (red) signal, a G (green) signal, and a B (blue) signal which are color signals related to luminance (step S11). Note that, the image data is data having a resolution of 600 dpi and 8 bits, i.e., 256 tone levels, for each color of RGB in the present embodiment.

Next, the image data is converted by using a color conversion table stored in the HDD 303, so that ink color data indicated by a C (cyan) signal, an M (magenta) signal, a Y (yellow signal), and a K (black) signal which are color signals related to colors of ink is generated (step S12). In this case, the ink color data is data having a resolution of 600 dpi and 8 bits, i.e., 256 tone levels, for each color of CMYK.

Next, the ink color data is subjected to quantization (binarization) by using a dither pattern stored in the HDD 303 and quantization data for deciding ejection or non-ejection of each ink to each pixel area is generated (step S13). As a result, the quantization data becomes data having a resolution of 600 dpi and 1 bit, i.e., 2 tone levels, for each color of CMYK. Note that, though an aspect in which a dithering method using a dither pattern is executed as the quantization processing is described here, the quantization processing may be executed by other methods such as an error diffusion method.

Next, by using a mask pattern stored in the HDD 303 for the quantization data, the quantization data is distributed to a plurality of ejection port arrays that eject each ink and recording data used for recording is generated (step S14). For example, by executing such distribution processing for the quantization data corresponding to the ejection port arrays 201*a* to 201*h* in the recording element substrate 201 for the black ink, 8 kinds of recording data for performing recording on the recording medium 106 are able to be generated from the ejection port arrays 201*a* to 201*h*.

Though an aspect in which steps S11 to S14 are all executed by the CPU 301 in the host PC 300 is described here, steps S11 to S14 may be executed in accordance with another aspect. For example, steps S11 to S14 may be all executed by the CPU 311 in the printer 100. Additionally, for example, an aspect in which steps S11 to S14 are executed in such a shared manner that steps S11 and S12 are executed by the CPU 301 in the host PC 300 and steps S13 and S14 are executed by the CPU 311 in the printer 100 may be used.

(Time Divisional Driving Control)

In a case where a recording head in which a great number of recording elements are arranged is used, when all of the recording elements in the recording head are driven at the same time and ink is ejected at the same timing, a large-capacity power supply is required. For suppressing such an increase in the capacity of the power supply, it is generally known to perform so-called time divisional driving control in which recording elements in a recording head are divided into a plurality of driving blocks and a timing at which each driving block is driven to perform recording is differentiated in the same row. The time divisional driving control enables the number of recording elements that are driven at the same time to be reduced, so that the capacity of the power supply required for a recording apparatus is able to be suppressed.

Figures 6A, 6B:
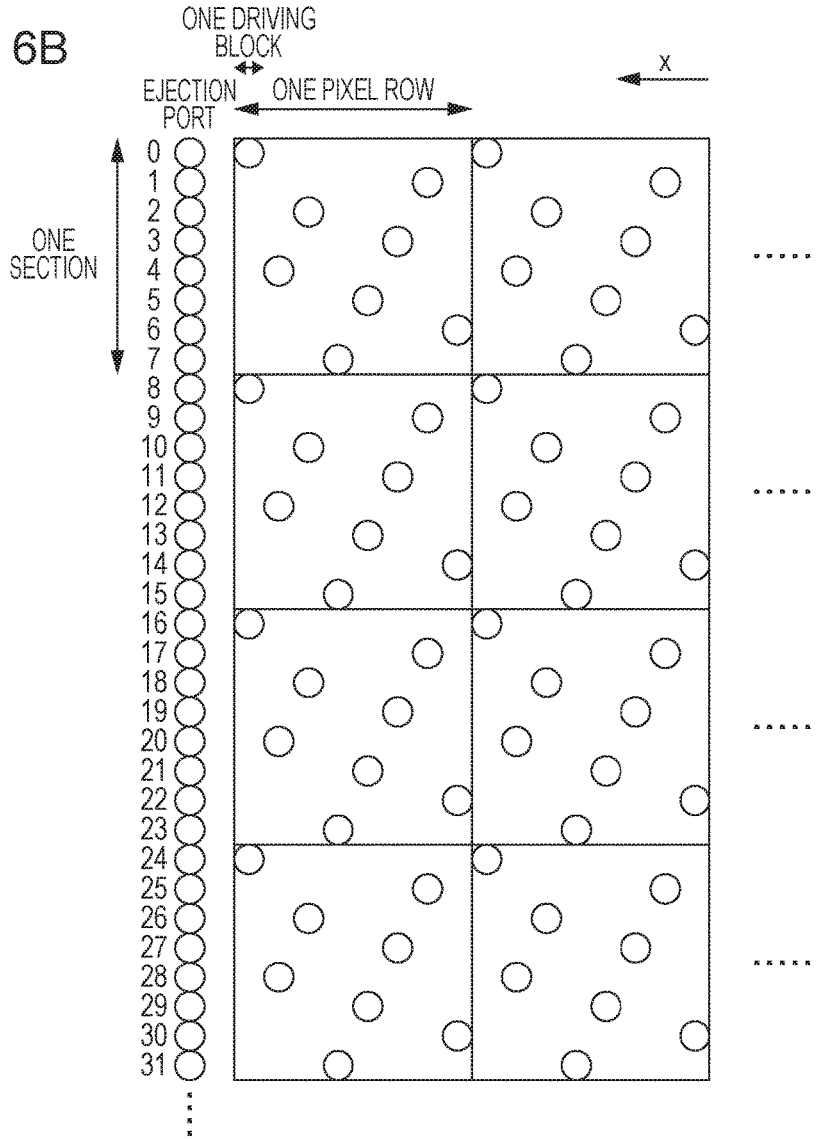
FIGS. 6A and 6B are views for explaining time divisional driving control in the embodiment.

FIGS. 6A and 6B are views for explaining time divisional driving control executed in the present embodiment. FIG. 6A illustrates correspondence between driving order in the time divisional driving control and driving blocks that are driven in each driving order. FIG. 6B schematically illustrates positions at which ink is ejected when the time divisional driving is performed on the basis of the correspondence between the driving order and the driving blocks illustrated in FIG. 6A.

Note that, for simplification of description, only ejection from the ejection port array 201*a* provided on the recording element substrate 201 in the recording head 101 will be described below. In the following description, an ejection port at an end on one side (an upper side in FIG. 6B) of the ejection port array 201 in the y direction is referred to as an ejection port "0" with the numbers increased by one toward the other side (a lower side in FIG. 6B) in the y direction in a manner of an ejection port "1", an ejection port "2", an ejection port "3", . . . , and an ejection port at an end on the other side in the y direction is referred to as an ejection port "1279".

In the present embodiment, it is assumed that a plurality of ejection ports in the ejection port array 201*a* serve as one section composed of 8 recording elements consecutive in the y direction and recording elements corresponding to ejection ports located at the relatively same positions in each of sections form the same driving block. For example, recoding elements corresponding to the ejection port "0", the ejection port "8", the ejection port "16", . . . , and so on that are located at the top in the sections form a driving block "1". In other words, recording elements corresponding to the ejection ports "8×k (k is an integer of 0 or more)" form the driving block "1". Moreover, recording elements corresponding to the ejection port "1", the ejection port "9", the ejection port "17", . . . , and so on that are located at the second from the top in the sections form a driving block "2". In other words, recording elements corresponding to the ejection ports "8×k+1 (k is an integer of 0 or more)" form the driving block "2". Similarly, recording elements corresponding to the ejection ports "8×k+2 (k is an integer of 0 or more)" form a driving block "3", recording elements corresponding to the ejection ports "8×k+3 (k is an integer of 0 or more)" form a driving block "4", recording elements corresponding to the ejection ports "8×k+4 (k is an integer of 0 or more)" form a driving block "5", recording elements corresponding to the ejection ports "8×k+5 (k is an integer of 0 or more)" form a driving block "6", recording elements corresponding to the ejection ports "8×k+6 (k is an integer of 0 or more)" form a driving block "7", and recording elements corresponding to the ejection ports "8×k+7 (k is an integer of 0 or more)" form a driving block "8".

In the present embodiment, setting of the driving order is stored the ROM 313 within the recording apparatus 100 and transmitted to the recording head. A block enable signal is transmitted to the recording head at a predetermined interval on the basis of the received driving order and a driving signal is flowed into the recording elements in accordance with AND of the block enable signal and recording data. In the present embodiment, the block enable signal is applied so that the recording elements belonging to each of the driving blocks are driven in order of the driving blocks "1", "5", "3", "8", "6", "4", "2", and "7" as the driving order, as illustrated in FIG. 6B. As a result, ink is ejected at different positions in the x direction for each of the driving blocks even in the same pixel row, as illustrated in FIG. 6B. Specifically, the ejection ports "8×k (k is an integer of 0 or more)", the ejection ports "8×k+4 (k is an integer of 0 or more)", the ejection ports "8×k+2 (k is an integer of 0 or more)", the ejection ports "8×k+7 (k is an integer of 0 or more)", the ejection ports "8×k+5 (k is an integer of 0 or more)", the ejection ports "8×k+3 (k is an integer of 0 or more)", the ejection ports "8×k+1 (k is an integer of 0 or more)", and the ejection ports "8×k+6 (k is an integer of 0 or more)" eject ink in this order from a downstream side in the x direction.

(Method for Determining Ejection Failure)

The recording head in the present embodiment has one ejection determination detection circuit connected to a plurality of ejection ports arranged in one ejection port array (for example, the ejection port array 201*a*). When an ejection operation is performed from an ejection port, the ejection determination detection circuit detects a temperature change, a pressure change, or the like associated with the ejection operation. When the temperature change or the pressure change is different from a change during a normal ejection operation, it is determined that ejection failure is generated in the ejection port. However, as the ejection determination detection circuit is used in a shared manner to determine ejection failure in the ejection ports, the ejection determination detection circuit is able to perform the determination only for one ejection port at the same timing.

In a case where the aforementioned time divisional driving control is performed in this case, even when ejection of ink is decided in the same pixel row by the recording data, recording elements belonging to different driving blocks are not driven at the same timing. For example, the ejection port "0" of the ejection ports "8×k (k is an integer of 0 or more)" and the ejection port "1" of the ejection ports "8×k+1 (k is an integer of 0 or more)" are driven at different timings. Thus, the ejection failure determination is able to be performed for both the ejection port "0" and the ejection port "1" in one pixel row.

On the other hand, ejection ports corresponding to recording elements belonging to the same driving block, for example, the ejection port "0" and the ejection port "8" of the ejection ports "8×k (k is an integer of 0 or more)" can be driven at the same timing. Thus, the ejection failure determination is not able to be performed for both the ejection port "0" and the ejection port "8" in one pixel row.

In view of the aforementioned points, in the present embodiment, one ejection port is selected in accordance with a selection method described below from among ejection ports corresponding to recording elements belonging to the same driving block in each pixel row and ejection failure determination is performed for the selected ejection port. For simplify the description below, only the ejection ports "8×k (k is an integer of 0 or more)" will be described. Further, for simplification, it is assumed that the ejection ports "8×k (k is an integer of 0 or more)" are composed of eight ejection ports "0", "8", "16", "24", "32", "40", "48", and "56".

Figure 7:
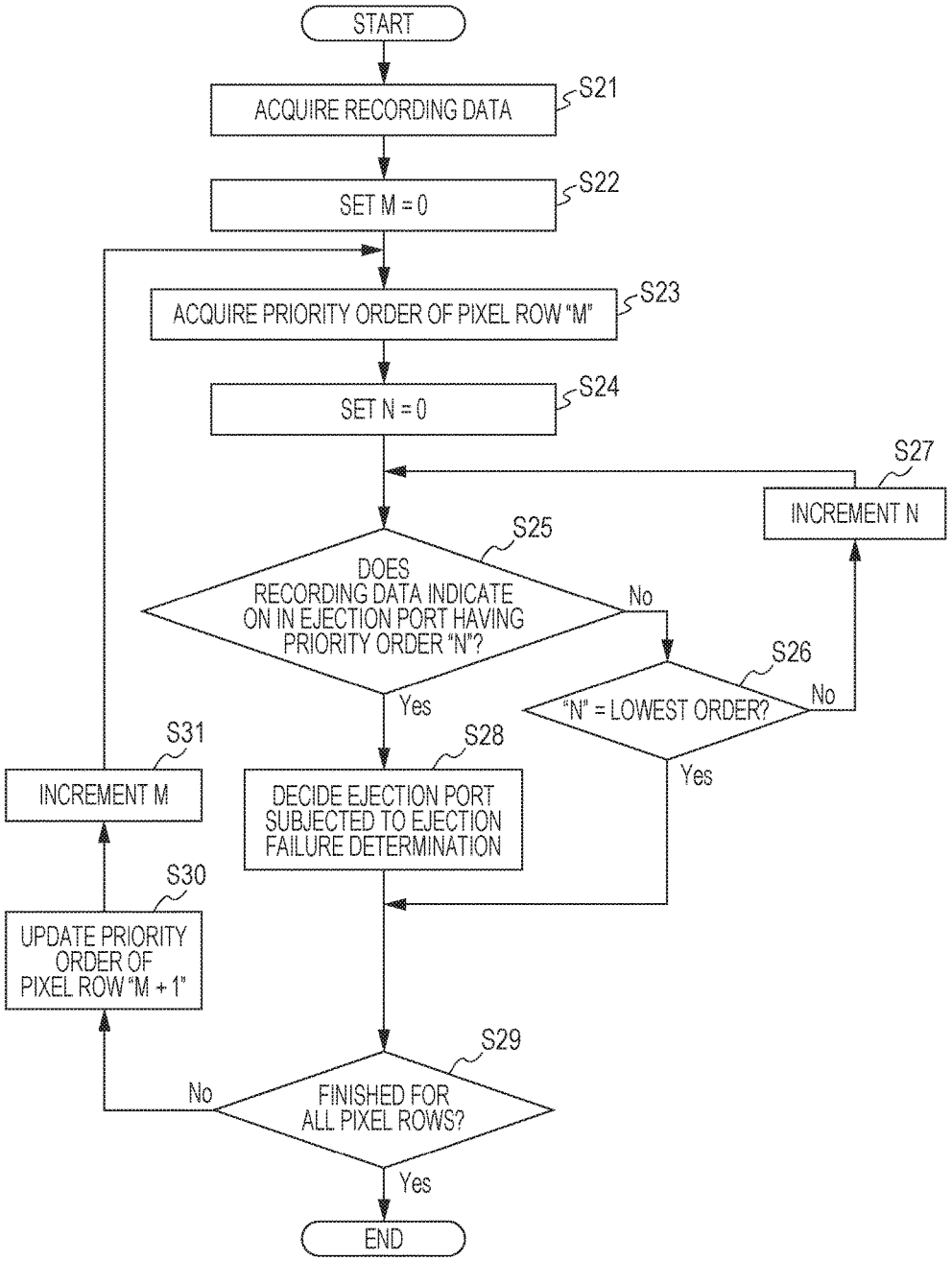
FIG. 7 is a flowchart indicating a process of ejection failure determination processing according to the embodiment.

FIG. 7 is a flowchart indicating a process of processing, executed by the CPU 311 in accordance with a control program in the present embodiment, for deciding an ejection port subjected to ejection failure determination in each pixel row. Note that, the control program is stored in the ROM 313 in advance.

First, when the processing indicated in FIG. 7 starts, the recording data generated through the aforementioned image processing at step S21 is acquired.

Next, a value of "M" is set to "0" to perform ejection failure determination in the pixel row "0" at step S22. Then, information indicating priority order in the pixel row "M" is acquired at step S23.

In this case, any value of "0" to "7" is set to each of a plurality of ejection ports as the information indicating the priority order in the present embodiment. Note that, a smaller number corresponds to higher priority order. For example, "0" corresponds to the highest priority order and "7" corresponds to the lowest priority order.

At this stage, the value of "M" is set to "0" at step S22, so that the information indicating the priority order (initial priority order) of the pixel row "0" is acquired. Note that, it is assumed that the initial priority order is decided so that all the ejection ports have the lowest priority of "7".

Next, at step S24, a value of "N" is set to "0" to determine whether or not ejection of ink is decided by the recording data in order from the ejection port given higher priority. Then, whether or not ejection of ink is decided (ON is indicated) by the recording data is determined for the ejection port having the priority order "N" at step S25.

When it is determined that ejection of ink is decided at step S25, the procedure proceeds to step S28 and the ejection port having the priority order "N" is decided as the ejection port subjected to the ejection failure determination in the pixel row "M". Note that, in a case where there are a plurality of ejection ports having the priority order "N", the processing of step S25 is performed in order from the ejection port having a smaller number. Then, the procedure proceeds to step S29 described below.

On the other hand, when it is determined that non-ejection of ink is decided at step S25, the procedure proceeds to step S26 and whether or not the priority order "N" is the lowest order is determined. In a case of being not the lowest order, the procedure proceeds to step S27 and processing of incrementing "N" to "N+1" is performed. Then, the procedure returns to step S25 and the processing which has been performed for the ejection port having the priority order "N" before is now executed for an ejection port having the priority order "N+1". On the other hand, when it is determined that the priority order is the lowest at step S26, since there is no other ejection port subjected to the ejection failure determination, the ejection failure determination is not performed for the corresponding pixel row and the procedure proceeds to step S29.

That is, by performing steps S25, S26, and S27 in the present embodiment, it is possible to determine whether or not ejection of ink is decided by the recording data in order from the ejection port having higher priority order so that the ejection port that is determined as being decided to perform ejection of ink first is selected as the ejection port subjected to the ejection failure determination.

At step S29, whether or not the ejection failure determination processing is finished for all the pixel rows is determined. When it is determined that the ejection failure determination processing is finished, the processing in FIG. 7 ends.

On the other hand, when it is determined at step S29 that there is a pixel row for which the ejection failure determination processing has not been performed yet, the procedure proceeds to step S30 and the priority order in the pixel row "M+1" in which recoding is to be performed after the pixel row "M" in which the ejection failure determination processing has been performed before is updated.

In this case, the priority order is updated in accordance with the following rule. That is, the priority order in the pixel row "M+1" is updated in such a manner that, compared to the priority order in the pixel row "M", the ejection port for which the ejection failure determination has been performed in the pixel row "M" has the lowest priority order in the pixel row "M+1" and the ejection port for which the ejection failure determination has not been performed in the pixel row "M" has higher priority order by one in the pixel row "M+1".

The procedure then proceeds to step S31 and processing for incrementing "M" to "M+1" is performed. After that, the procedure returns to step S23 and the processing which has been performed for the pixel row "M" before is now executed for the pixel row "M+1".

Figures 8A, 8B:
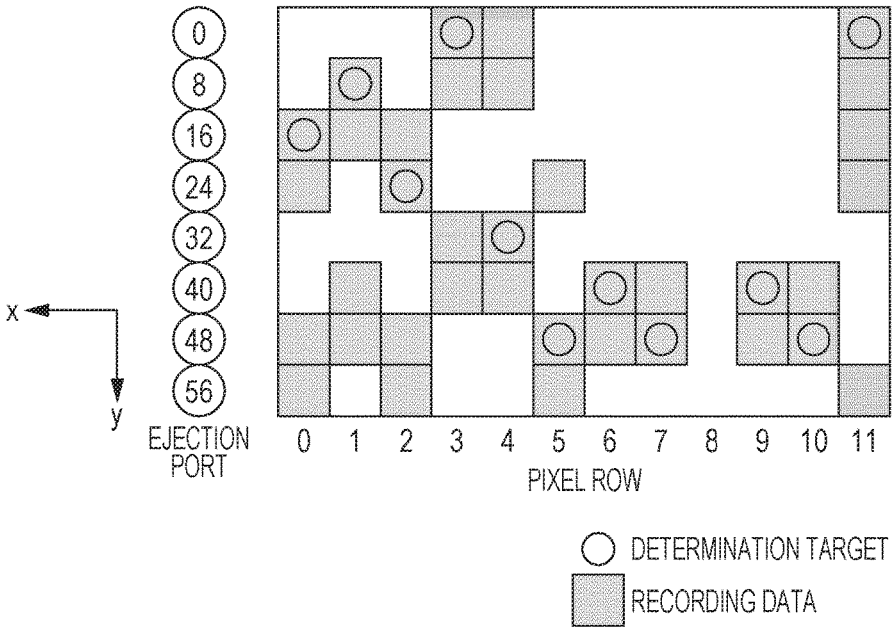
FIGS. 8A and 8B are views for explaining ejection failure determination processing in the embodiment.

FIGS. 8A and 8B are views for explaining an ejection port that is selected in each pixel row for determining presence/absence of ejection failure in the present embodiment. FIG. 8A illustrates priority order in each pixel row. FIG. 8B illustrates an example of recording data and indicates, when the recording data is acquired, which ejection port is actually selected as the ejection port subjected to the ejection failure determination in each of the pixel rows. The process for performing the ejection failure determination in accordance with the flowchart of FIG. 7 will be specifically described below with reference to FIGS. 8A and 8B.

After the ejection failure determination processing starts and the processing of steps S21 and S22 is finished, the priority order of the pixel row "0" is acquired at step S23. As described above, the initial priority order is the lowest order of "7" in all the ejection ports. Thus, as illustrated in FIG. 8A, all the ejection ports "0", "8", "16", "24", "32", "40", "48", and "56" in the pixel row "0" have the priority order "7".

Next, the processing subsequent to step S24 is performed, and since there is no ejection port having the higher priority order "0" to "6" in the pixel row "0", increment of "N" at step S27 is repeated until "7" is provided as "N".

After "7" is provided as "N", whether or not ejection of ink is decided by the recording data is determined for the ejection ports having the priority order "7" in order from the ejection port having a smaller number at step S25. First, the determination is performed for the ejection ports "0" and "8", and since non-ejection of ink is decided for the ejection ports in the pixel row "0", the ejection ports are not selected as the ejection ports subjected to the ejection failure determination. Next, the determination is performed for the ejection port "16", and since ejection of ink is decided for the ejection port "16", the procedure proceeds to step S28 and the ejection port "16" is decided as the ejection port subjected to the ejection failure determination in the pixel row "0".

It is determined that the ejection port subjected to the ejection failure determination has not been decided yet in all the pixel rows at step S29, the procedure proceeds to step S30, and the priority order is updated in the next pixel row "1". As the ejection port "16" is decided as the ejection port subjected to the ejection failure determination in the pixel row "0", the priority order is updated in the pixel row "1" so that the ejection port "16" has the lowest priority order and the ejection ports other than the ejection port "16" have higher priority order by one. As a result, according to the updated priority order, the priority order of the ejection port "16" is "7" and the priority order of the ejection ports other than the ejection port "16" is "6" in the pixel row "1" as illustrated in FIG. 8A. Then, "M" is incremented at step S31 and the priority order of the pixel row "1" is acquired at step S23.

Next, the processing subsequent to step S24 is performed, and since there is no ejection port having the higher priority order "0" to "5" in the pixel row "1", increment of "N" at step S27 is repeated until "6" is provided as "N".

After "6" is provided as "N", whether or not ejection of ink is decided by the recording data is determined for the ejection ports having the priority order "6" in order from the ejection port having a smaller number at step S25. First, the determination is performed for the ejection port "0", and since non-ejection of ink is decided for the ejection port "0" in the pixel row "1", the ejection port "0" is not selected as the ejection port subjected to the ejection failure determination. Next, the determination is performed for the ejection port "8", and since ejection of ink is decided for the ejection port "8", the procedure proceeds to step S28 and the ejection port "8" is decided as the ejection port subjected to the ejection failure determination in the pixel row "1".

It is determined at step S29 that the ejection port subjected to the ejection failure determination has not been decided yet in all the pixel rows, the procedure proceeds to step S30, and the priority order is updated in the next pixel row "2". As the ejection port "8" is decided as the ejection port subjected to the ejection failure determination in the pixel row "1", the priority order is updated in the pixel row "2" so that the ejection port "8" has the lowest priority order and the ejection ports other than the ejection port "8" have higher priority order by one. As a result, according to the updated priority order, the priority order of the ejection port "8" is "7", the priority order of the ejection port "16" is "6", and the priority order of the ejection ports other than the ejection ports "8" and "16" is "5" in the pixel row "2" as illustrated in FIG. 8A. Then, "M" is incremented at step S31 and the priority order of the pixel row "2" is acquired at step S23.

Next, the processing subsequent to step S24 is performed, and since there is no ejection port having the higher priority order "0" to "4" in the pixel row "2", increment of "N" at step S27 is repeated until "5" is provided as "N".

After "5" is provided as "N", whether or not ejection of ink is decided by the recording data is determined for the ejection ports having the priority order "5" in order from the ejection port having a smaller number at step S25. First, the determination is performed for the ejection port "0", and since non-ejection of ink is decided for the ejection port "0" in the pixel row "2", the ejection port "0" is not selected as the ejection port subjected to the ejection failure determination. Next, the determination is performed for the ejection port "24", and since ejection of ink is decided for the ejection port "24", the procedure proceeds to step S28 and the ejection port "24" is decided as the ejection port subjected to the ejection failure determination in the pixel row "2".

Subsequently, the ejection port subjected to the ejection failure determination is decided similarly in each of the pixel rows "3" to "11". As a result, the ejection port "0", the ejection port "32", the ejection port "48", the ejection port "40", the ejection port "48", the ejection port "40", the ejection port "48", and the ejection port "0" are respectively decided as the ejection ports subjected to the ejection failure determination in the pixel row "3", the pixel row "4", the pixel row "5", the pixel row "6", the pixel row "7", the pixel row "9", the pixel row "10", and the pixel row "11". No ejection port ink ejection of which is decided by the recording data is found in the pixel row "8" even when the priority order is the lowest, Yes is determined at step S26 and it is decided that the ejection failure determination is not performed in the pixel row "8".

When a recording operation is performed, whether or not there is ejection failure in the ejection port selected as described above in each of the pixel rows is determined. When it is determined that there is ejection failure, so-called non-ejection complementary processing in which instead of ink to be originally ejected from the selected ejection port, ink is ejected from another ejection port is performed. Various processing is able to be performed as the non-ejection complementary processing. For example, so-called different array complementary processing in which ejection failure in the ejection port "0" in the ejection port array 201*a* is complemented by an ejection port "0" in a different ejection port array (for example, the ejection port array 201*b*) from which ejection is normally performed may be performed. In addition, for example, so-called adjacent complementary processing in which ejection failure in the ejection port "8" in the ejection port array 201*a* is complemented by an adjacent ejection port (for example, the ejection port "9"), from which ejection is normally performed, in the ejection port array 201*a* may be performed.

As found from FIG. 8B, according to the present embodiment, ejection ports subjected to ejection failure determination are able to be evenly selected along the x direction.

Second Embodiment

In the first embodiment described above, an aspect in which a plurality of ejection ports belonging to the same driving block can have the same priority order in the same pixel row has been described.

On the other hand, in the present embodiment, an aspect in which a plurality of ejection ports belonging to the same driving block have different priority order in the same pixel row will be described.

Note that, description for a portion similar to that of the first embodiment described above will be omitted.

In the present embodiment as well, similarly to the first embodiment, any value of "0" to "7" is set to each of the plurality of ejection ports as information indicating priority order. However, as described above, only different priority order is set to the plurality of ejection ports belonging to the same driving block in the same pixel row. Thus, the priority order is set to be different from each other in the pixel row "0" in such a manner that the ejection ports "0", "8", "16", "24", "32", "40", "48", and "56" have priority order of "0", "1", "2", "3", "4", "5", "6", and "7", respectively.

Further, when updating the priority order in the pixel row "M+1" at step S30, the priority order is set as follows. An ejection port that is decided to be subjected to the ejection failure determination in the pixel row "M" has the lowest priority order in the pixel row "M+1". The priority order of the ejection port, for which the priority order lower than the priority order of the ejection port which is decided to be subjected to the ejection failure determination in the pixel row "M" is decided among the ejection ports which are decided not to be subjected to the ejection failure determination in the pixel row "M", is set to be higher by one in the pixel row "M+1". The priority order of the ejection port, for which the priority order higher than the priority order of the ejection port which is decided to be subjected to the ejection failure determination in the pixel row "M" is decided among the ejection ports which are decided not to be subjected to the ejection failure determination in the pixel row "M", is set to be the same as the priority order in the pixel row "M" also in the pixel row "M+1". Updating the priority order in this manner makes it possible to set the priority order to be different from each other among the plurality of ejection ports belonging to the same driving block also in the pixel row "M+1".

Figures 9A, 9B:
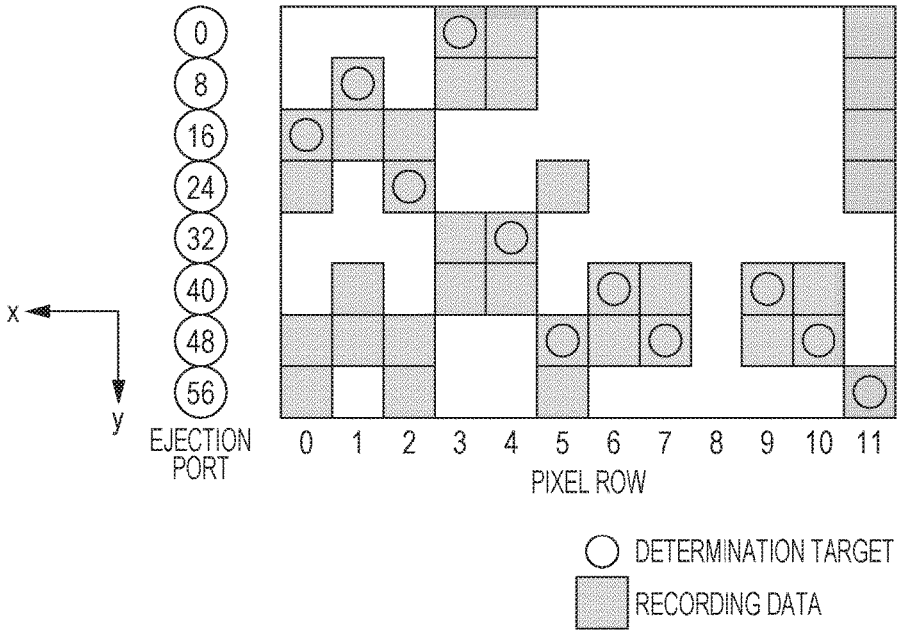
FIGS. 9A and 9B are views for explaining ejection failure determination processing in an embodiment.

FIGS. 9A and 9B are views for explaining an ejection port that is selected in each pixel row for determining presence/absence of ejection failure in the present embodiment. FIG. 9A illustrates priority order in each pixel row. FIG. 9B illustrates an example of recording data and indicates, when the recording data is acquired, which ejection port is actually selected as the ejection port subjected to ejection failure determination in each of the pixel rows. The process for performing the ejection failure determination in accordance with the flowchart of FIG. 7 will be specifically described below with reference to FIGS. 9A and 9B.

After the ejection failure determination processing starts and the processing of steps S21 and S22 is finished, the priority order of the pixel row "0" is acquired at step S23. As described above, the initial priority order is set so that the ejection ports "0", "8", "16", "24", "32", "40", "48", and "56" respectively have the priority order of "0", "1", "2", "3", "4", "5", "6", and "7" as illustrated in FIG. 9A.

Next, "N"="0" is set at step S24 and it is determined at step S25 that ejection of ink is not decided by the recording data for the ejection port "0" having the priority order "0". Thus, through step S26, "N" is incremented at step S27 and "N"="1" is set. Then, it is now determined at step S25 that ejection of ink is not decided by the recording data also for the ejection port "8" having the priority order "1". Thus, "N" is incremented at step S27 in the same manner and "N"="2" is set.

Further, it is determined at step S25 that ejection of ink is decided by the recording data for the ejection port "16" having the priority order "2". Thus, the procedure proceeds to step S28 and the ejection port "16" is decided as the ejection port subjected to the ejection failure determination in the pixel row "0".

Next, it is determined at step S29 that the ejection port subjected to the ejection failure determination has not been decided yet in all the pixel rows, the procedure proceeds to step S30, and the priority order is updated in the next pixel row "1". As the ejection port "16" is decided as the ejection port subjected to the ejection failure determination in the pixel row "0", the priority order is updated in the pixel row "1" so that the ejection port "16" has the lowest priority order of "7". Moreover, the ejection port "16" serving as the ejection port subjected to the ejection failure determination is decided to have the priority order "2" in the pixel row "0". Thus, the priority order is updated in the pixel row "1" so that, compared to the pixel row "0", the priority order of the ejection ports "0" and "8" for which the priority order higher than the priority order "2" is decided does not change and the priority order of the ejection ports "24", "32", "40", "48", and "56" for which the priority order lower than the priority order "2" is decided becomes higher by one. As a result, in the pixel row "1", the priority order of the ejection ports "0", "8", "16" "24", "32", "40", "48", and "56" is "0", "1", "7", "2", "3", "4", "5", and "6", respectively. Then, "M" is incremented at step S31 and the priority order of the pixel row "1" is acquired at step S23.

Subsequently, decision of the ejection port subjected to the ejection failure determination in each of the pixel rows "1" to "11" and update of the priority order in the next pixel row are similarly performed repeatedly. Now, a case where decision of the ejection port subjected to the ejection failure determination in the pixel row "10" is finished and the priority order of the next pixel row "11" is updated is considered. As a result, the priority order of the ejection ports "0", "8", "16" "24", "32", "40", "48", and "56" is "4", "2", "1", "3", "5", "6", "7", and "0", respectively in the pixel row "11" as illustrated in FIG. 9A.

Then, "N"="0" is set at step S24 and it is determined at step S25 that ejection of ink is decided for the ejection port "56" having the priority order "0". Thus, the procedure proceeds to step S28 and the ejection port "56" is decided as the ejection port subjected to the ejection failure determination in the pixel row "11".

As found from comparison of ejection ports subjected to the ejection failure determination, which are decided in the present embodiment as illustrated in FIG. 9B, to ejection ports subjected to the ejection failure determination, which are decided in the first embodiment as illustrated in FIG. 8B, according to the present embodiment as well, ejection ports subjected to ejection failure determination are able to be evenly selected along the x direction similarly to the first embodiment.

While the ejection port "0" is selected as the ejection port subjected to the ejection failure determination in the pixel row "11" in the first embodiment illustrated in FIG. 8B, the ejection port "56" is selected as the ejection port subjected to the ejection failure determination in the pixel row "11" in the present embodiment illustrated in FIG. 9B. Though the ejection port "0" is selected as the ejection port subjected to the ejection failure determination in the pixel row "3" in both FIG. 8B and FIG. 9B, the ejection port "56" is not selected as the ejection port subjected to the ejection failure determination in any of the pixel rows "0" to "10". Thus, it is found that the present embodiment in which the ejection port "56" is selected as the ejection port subjected to the ejection failure determination in the pixel row "11" makes it possible to select ejection ports subjected to the ejection failure determination more evenly than the first embodiment.

This is because only one priority order is assigned to each of a plurality of ejection ports and the priority order of the ejection port having the highest priority does not change unless being decided to be subjected to the ejection failure determination in the present embodiment. Thus, in the present embodiment illustrated in FIG. 9B, after the priority order of the ejection port "56" becomes the highest priority order "0" in the pixel row "7", only the ejection port "56" has the priority order "0" in the pixel rows "8" to "11", so that the ejection port "56" is always selected as the ejection port subjected to the ejection failure determination when ejection of ink is decided for the ejection port "56" by the recording data in the pixel row "11".

On the other hand, a plurality of ejection ports can have the same priority order in the first embodiment illustrated in FIG. 8B. Thus, the priority order of not only the ejection port "56" but also the ejection ports "0", "8", "16", and "24" is the highest order "0" in the pixel row "11". Thereby, not the ejection port "56" for which the ejection failure determination has not been performed in the pixel rows "0" to "10" but the ejection port "0" for which the ejection failure determination has been already performed in the pixel row "3" is selected as the ejection port subjected to the ejection failure determination.

As described above, according to the present embodiment, ejection ports subjected to ejection failure determination are able to be evenly selected in a more suitable manner than the first embodiment.

Note that, though an aspect in which the ejection port subjected to the ejection failure determination is selected in each of the pixel rows while updating the priority order (initial priority order) for each of the pixel rows has been described in the second embodiment described above, another aspect may be used. Even though by performing the ejection failure determination while updating always the same initial priority order, ejection ports subjected to the ejection failure determination are selected in a distributed manner to some extent by updating of the priority order in each of the pixel rows, the ejection port that is decided to have the higher order as the initial priority order initially is preferentially selected as the ejection port subjected to the ejection failure determination. Thus, in view of a whole of the pixel rows, the ejection port that is decided to have the higher order as the initial priority order is slightly more frequently selected as the ejection port subjected to the ejection failure determination.

By resetting the priority order and newly setting different initial priority order at each predetermined timing, the aforementioned problem is able to be solved. For example, ejection ports subjected to the ejection failure determination may be selected while updating the initial priority order, in which the ejection ports "0", "8", "16", "24", "32", "40", "48", and "56" respectively have the priority order "0", "1", "2", "3", "4", "5", "6", and "7", in each of the pixel rows until the predetermined timing has come, and ejection ports subjected to the ejection failure determination may be selected while updating the initial priority order, in which the ejection ports "0", "8", "16", "24", "32", "40", "48", and "56" respectively have the priority order "4", "5", "6", "7", "0", "1", "2", and "3", in each of the pixel rows after the predetermined timing has come.

Described here is order in which the initial priority order used until the predetermined timing has come and the initial priority order used after the predetermined timing has come are mutually offset. This is because it is only required that one initial priority order and an offset value (in the aforementioned example, an offset value=+4 as the initial priority order of the ejection port "0" is changed from "0" to "4") are stored in the ROM 313 to achieve the mutually offset order and this results in reduction of a capacity of the ROM 313. Of course, the order may not be the order in which the initial priority order used until the predetermined timing has come and the initial priority order used after the predetermined timing has come are mutually offset and may be uncorrelated order.

The timing when the initial priority order is switched may be varied as appropriate. For example, the initial priority order may be changed at a timing when recording for one page is finished or the initial priority order may be changed for each of the predetermined number of pixel rows.

Other Embodiments

Embodiment(s) of the disclosure can also be realized by a computer of a system or apparatus that reads out and executes computer executable instructions (e.g., one or more programs) recorded on a storage medium (which may also be referred to more fully as a 'non-transitory computer-readable storage medium') to perform the functions of one or more of the above-described embodiment(s) and/or that includes one or more circuits (e.g., application specific integrated circuit (ASIC)) for performing the functions of one or more of the above-described embodiment(s), and by a method performed by the computer of the system or apparatus by, for example, reading out and executing the computer executable instructions from the storage medium to perform the functions of one or more of the above-described embodiment(s) and/or controlling the one or more circuits to perform the functions of one or more of the above-described embodiment(s). The computer may comprise one or more processors (e.g., central processing unit (CPU), micro processing unit (MPU)) and may include a network of separate computers or separate processors to read out and execute the computer executable instructions. The computer executable instructions may be provided to the computer, for example, from a network or the storage medium. The storage medium may include, for example, one or more of a hard disk, a random-access memory (RAM), a read only memory (ROM), a storage of distributed computing systems, an optical disk (such as a compact disc (CD), digital versatile disc (DVD), or Blu-ray Disc (BD)), a flash memory device, a memory card, and the like.

Though an aspect in which with the use of a recording head, as illustrated in FIG. 2, which has a longer width than that of a recording medium, ink is ejected while conveying the recording medium in a direction crossing a direction in which ejection ports are arranged and recording on the recording medium is completed by single conveyance (movement) has been described in the embodiments described above, another aspect may be used. For example, an aspect in which an ejection operation of ejecting ink while performing scanning with a recording head in a direction crossing a direction in which ejection ports are arranged and a conveyance operation of conveying a recording medium in the arrangement direction during the scanning are repeated and recording on the recording medium is completed by multiple scanning (movement) may be used.

With the recording apparatus according to the embodiments, in a case where ejection failure determination is able to be performed only for one ejection port of a plurality of ejection ports in one pixel row, presence/absence of ejection failure is able to be evenly determined for the ejection ports regardless of recoding data.

While the disclosure has been described with reference to exemplary embodiments, it is to be understood that the disclosure is not limited to the disclosed exemplary embodiments. The scope of the following claims is to be accorded the broadest interpretation so as to encompass all such modifications and equivalent structures and functions.

This application claims the benefit of Japanese Patent Application No. 2016-186131 filed Sep. 23, 2016, which is hereby incorporated by reference herein in its entirety.

What is claimed is:

1. A recording apparatus, comprising:

a recording head in which a plurality of ejection ports for ejecting ink are arranged in a predetermined direction;

an acquisition unit configured to acquire recording data for deciding ejection or non-ejection of ink to each pixel;

a control unit configured to cause the recording head to perform an ejection operation from the plurality of ejection ports on a basis of the recording data while relatively moving the recording head and a recording medium in a cross direction crossing the predetermined direction;

a selection unit configured to select a target ejection port, from among the plurality of ejection ports in accordance with a predetermined priority order of the plurality of ejection ports with respect to each of a plurality of pixel rows arranged in the cross direction, wherein a plurality of pixels are arranged in a predetermined direction in each of the pixel rows; and a determination unit configured to determine, on a basis of the ejection operation, whether or not the target ejection port selected by the selection unit with respect to each of the pixel rows in the cross direction is in ejection failure, wherein the selection unit updates priority order for selecting the target ejection port for subjecting to the determination by the determination unit so that a previous target ejection port selected by the selection unit for subjecting to the determination by the determination unit with respect to a pixel row corresponding to a previous ejection operation of two pixel rows adjacent to each other in the cross direction has lowest priority order with respect to a pixel row corresponding to a subsequent ejection operation and selects, on a basis of the updated priority order, a target ejection port for subjecting to the determination by the determination unit with respect to the pixel row for which the subsequent ejection operation is to be performed.

2. The recording apparatus according to claim 1, wherein the selection unit updates priority order with respect to the two pixel rows so that an ejection port which is not selected by the selection unit in the pixel row corresponding to the previous ejection operation has higher priority order with respect to the pixel row corresponding to the subsequent ejection operation.

3. The recording apparatus according to claim 2, wherein the selection unit updates priority order so that priority order of some ejection ports among the plurality of ejection ports is the same between the two pixel rows.

4. The recording apparatus according to claim 1, wherein the selection unit updates priority order with respect to the two pixel rows so that (i) an ejection port which is not selected by the selection unit with respect to the pixel row corresponding to the previous ejection operation and which has priority order higher than priority order of an ejection port which is selected by the selection unit with respect to the pixel row corresponding to the previous ejection operation has the same priority order with respect to the pixel row corresponding to the subsequent ejection operation and (ii) an ejection port which is not selected by the selection unit with respect to the pixel row corresponding to the previous ejection operation and which has priority order lower than priority order of the ejection port which is selected by the selection unit with respect to the pixel row corresponding to the previous ejection operation has higher priority order with respect to the pixel row corresponding to the subsequent ejection operation.

5. The recording apparatus according to claim 4, wherein the selection unit updates priority order so that priority order of the plurality of ejection ports is different between the pixel rows.

6. The recording apparatus according to claim 1, wherein the selection unit determines whether or not ejection of ink is decided by the recording data in order from an ejection port having higher priority order with respect to each of the pixel rows and selects, as the target ejection port, an ejection port that is determined as being decided to perform ejection of ink first.

7. The recording apparatus according to claim 1, wherein the control unit performs control so that a plurality of driving blocks obtained by dividing the plurality of ejection ports in the recording head are driven at different timings with respect to the same pixel row to perform an ejection operation from the plurality of ejection ports, and the selection unit selects the target ejection port for each of the driving blocks with respect to the same pixel row.

8. The recording apparatus according to claim 1, wherein the selection unit (i) selects the target ejection port with respect to each of the pixel rows while updating a first initial priority order until a predetermined timing has come after an ejection operation by the control unit starts and (ii) selects the target ejection port with respect to each of the pixel rows while updating a second initial priority order different from the first initial priority order after the predetermined timing has come.

9. The recording apparatus according to claim 8, wherein the second initial priority order is order obtained by offsetting the first initial priority order.

10. The recording apparatus according to claim 1, further comprising a complementation unit configured to complement, by another ejection port from which ejection is normally performed, ejection of ink from an ejection port that is determined by the determination unit as having ejection failure.

11. The recording apparatus according to claim 1, wherein the recording head has one ejection determination detection circuit used for determination of the ejection failure in the ejection port by the determination unit connected to the plurality of ejection ports arranged in the ejection port array.

12. The recording apparatus according to claim 11, wherein when an ejection operation is performed from the ejection port, the ejection determination detection circuit detects at least one of a temperature change and a pressure change in the recording head associated with the ejection operation.

13. A recording method for performing recording by using a recording head in which a plurality of ejection ports for ejecting ink are arranged in a predetermined direction, comprising:

acquiring recording data for deciding ejection or non-ejection of ink to each pixel;

causing the recording head to perform an ejection operation from the plurality of ejection ports on a basis of the recording data while relatively moving the recording head and a recording medium in a cross direction crossing the predetermined direction;

selecting a target ejection port, from among the plurality of ejection ports in accordance with predetermined priority order of the plurality of ejection ports, with respect to each of a plurality of pixel rows arranged in the cross direction, wherein a plurality of pixels are arranged in a predetermined direction in each of the pixel row;

determining, on a basis of the ejection operation, whether or not the target ejection port selected with respect to each of the pixel rows in the cross direction are in ejection failure, and updating the priority order so that a previous target ejection port selected in with respect to a pixel row corresponding to a previous ejection operation of two pixel rows adjacent to each other in the cross direction has lowest priority order with respect to a pixel row corresponding to a subsequent ejection operation and selecting, on a basis of the updated priority order, a target ejection port for subjecting to the determination by the determination unit with respect to the pixel row for which the subsequent ejection operation is to be performed.

* * * * *